US005209549A

United States Patent [19]

Chang

[11] Patent Number: 5,209,549

[45] Date of Patent: May 11, 1993

[54] ADJUSTABLE ROTATION CHAIR

[76] Inventor: I-Shan Chang, No. 184, Pu Tze Pu, Wan Chao Ts'un, Chu Chee Hsiang, Chiayi Hsien, Taiwan

[21] Appl. No.: 705,993

[22] Filed: May 28, 1991

[51] Int. Cl.[5] ..... A47C 1/032

[52] U.S. Cl. ..... 297/320; 297/322; 297/349

[58] Field of Search ..... 297/349, 316, 317, 320–322, 297/328, 329

[56] References Cited

U.S. PATENT DOCUMENTS

| | | | |
|---|---|---|---|
| 4,607,883 | 8/1986 | Tzu-Chun | 297/320 X |
| 4,660,884 | 4/1987 | Terui et al. | 297/317 |
| 4,768,829 | 9/1988 | Goldman | 297/322 X |
| 4,877,291 | 10/1989 | Taylor | 297/321 |

FOREIGN PATENT DOCUMENTS

| | | | |
|---|---|---|---|
| 2153417 | 4/1980 | Fed. Rep. of Germany | 297/320 |

*Primary Examiner*—Peter R. Brown

*Attorney, Agent, or Firm*—Browdy and Neimark

[57] ABSTRACT

An adjustable chair which allows the user to select a desired lying position. It has a base of circular shape having a connection assembly to rotatably receive a framework, to which a hinged back and seat portions are secured. The framework has a slidable bar supporting the seat portion, while a pair of arms integrally formed on the framework are pivotedly connected to the back portion. Therefore, as one lying on the chair, by properly manipulating the body weight and adjusting the slidable bar, the chair can be adjusted to a desired inclined angle.

1 Claim, 3 Drawing Sheets 42
4

3
1A
1A
51
251
26
27

24
52
5
26
2
21
27
22
1B
1B
23

11
1
12

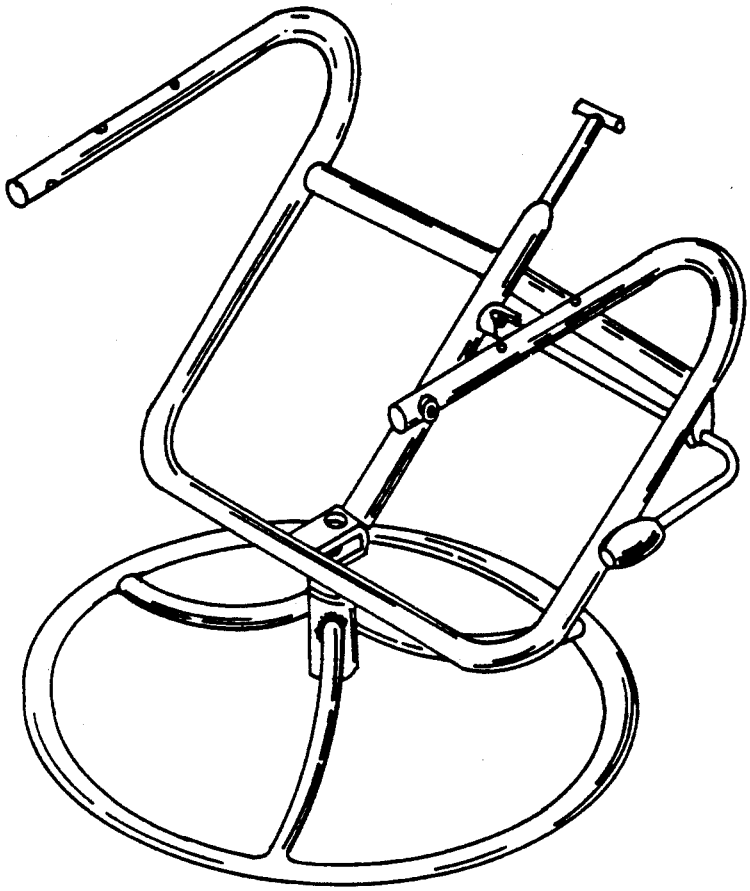
FIG. 2
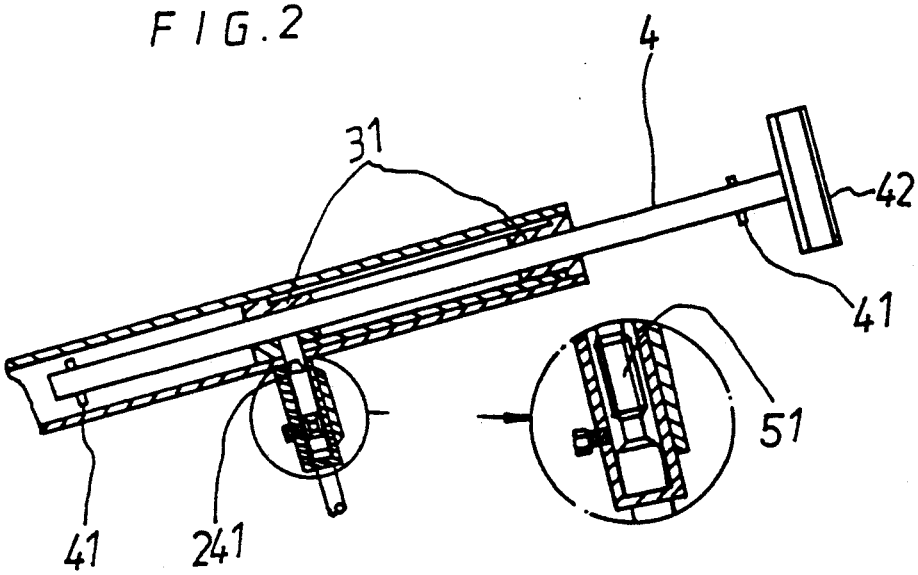
FIG. 3A
FIG. 3

ADJUSTABLE ROTATION CHAIR

BACKGROUND OF THE INVENTION

The present invention is related to an adjustable rotation chair, particularly to the kind having a collapsible framework pivotedly connected to its base.

The prior art discloses a chair which either has a rotatable or a reclinable chair body construction. These chairs having capability to adjust the declined angle generally are limited to certain preset angles. In other words, they are not continuously adjustable at any desired angle. However, it is desirable for the user to select an angle of their own.

SUMMARY OF THE INVENTION

The present invention provides a novel chair construction, which utilizes a framework having a slidable bar, rotatably mounted on a base. A back and seat portion are pivotedly connected and further placed on the framework, whereas the back is pinned with the arms of the framework, while the seat is secured to the slidable bar to adjust the inclined position of the chair.

Therefore, it is an object of the present invention to provide an adjustable rotation.

It is another object of the present invention to provide a chair to overcome the disadvantages set forth.

Other advantages and objectives will be appreciated as the invention becomes better understood by reference to the following description when considered in connection with the accompanying drawings.

BRIEF DESCRIPTION OF THE DRAWINGS

FIG. 2 is a perspective view showing the chair in assembly;

FIG. 3 is a partial cross sectional view showing the framework of the chair;

DETAILED DESCRIPTION OF THE PREFERRED EMBODIMENT

Figures 1, 1A, 1B, 1C:
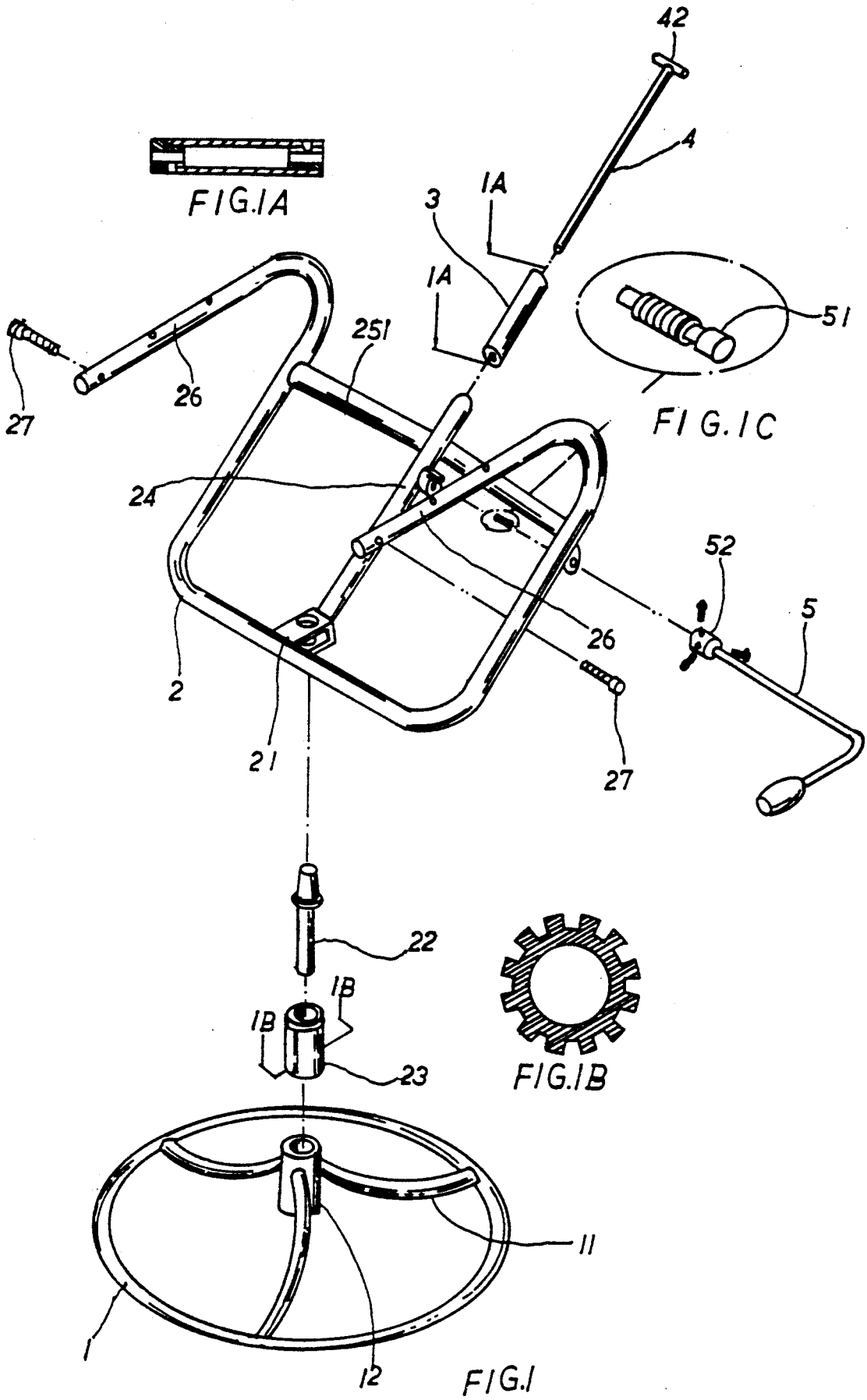
FIG. 1 is a perspective view showing an adjustable rotation chair according to the present invention.

An adjustable rotation chair according to the present invention has a base 1 generally being a ring shape member with a plurality of upward radical ribs 11 connected at center support 12.

Mounted rotatably at the center support is a framework 2 which has a generally rectangular shape with two backward extending arms 26, to be seated on the base by means of an U-shaped connecting plates 21 fixedly connected to the lower part of the framework. The connecting plates 2 have a pair of through holes defined on the plate walls to substantially receive a coned end of shaft 22, while the other end of the shaft 22 is rotatably connected through sleeve 23 to the center support.

The frame member is reinforced by first bar member 25 to resist transversal forces, and by second bar member 24 to resist longitudinal forces. The second bar member 24 is connected further to a tubular member 3, in which a pair of bearings 31 are mounted at both ends to receive a slidable bar 4.

The slidable bar 4 is provided with lateral pins 41 to define the limits within which bar 4 slides in tube 3. Bar 4 is also provided with a short bar 42 to partially support seat 6 when mounted on framework 2. The seat portion 6 is pivotedly connected to bar 4 through a holder 61 on seat 6 by a pin 62 (shown in FIG. 4).

The bar member 24 has a short bar member 241, which is laterally projected from the tubular member 3. The short bar member 241 has a screw shaft 51 to threadedly engage with a collar 52 of a L-shaped controlling bar 5, so that when the controlling bar is rotated, the screw shaft 51 is forced against the slidable bar; or to the contrast, permits bar 4 to slide.

Figures 4, 4A:
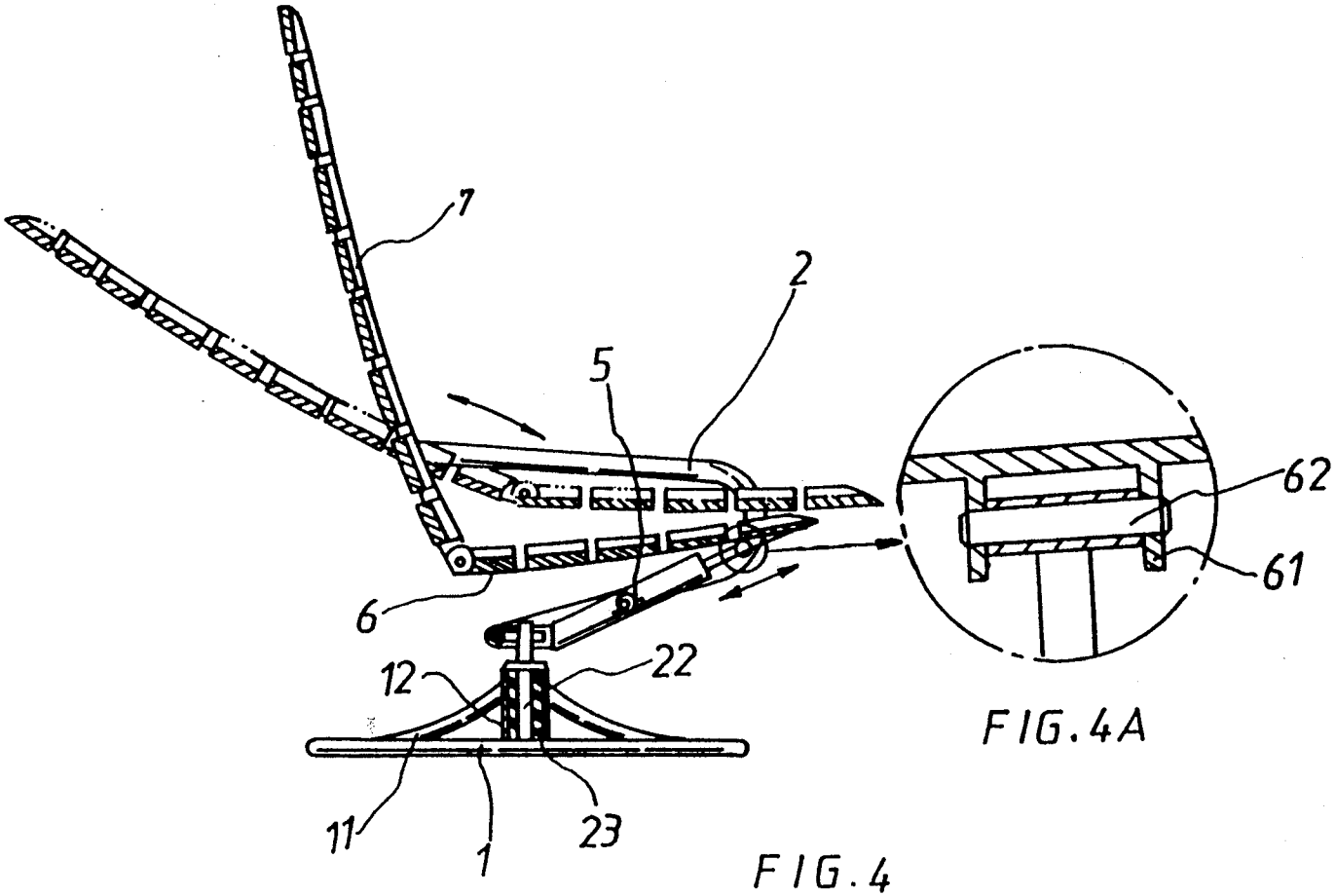
FIG. 4 is a side elevational view, wherein the arrows indicate the movement thereof.

Further referring to FIGS. 1 and 4, a seat 6 and a back 7 are hinged together, while the back 7 is further rotatably connected to the two arms 26 of the framework by threaded bolts 27. Therefore, by pivotedly connecting the seat 6 to the slidable bar 4, the seat 6 can be adjusted to inclined a desired angle.

As in operation, the controlling bar 5 is rotated to relieve the engagement of slidable bar 4, whereas the weight of human body will force the back 7 declining in the direction as shown in FIG. 4.

However, the controlling bar can be operated to secure the slidable bar after the desired position is reached.

The preferred embodiment of the present invention has been disclosed herein and shown in the accompanying drawings to illustrate the underlying principle of the invention, but it is to be understood that numerous modification may be made without departing from the spirit and scope of this invention.

What is claimed is:

1. A rotatable and adjustable chair, comprising:

a base for stabilizing said chair on a floor;

a frame rotatable on a shaft engaged in a bearing on said base;

said frame comprising:

a lower bar having an axis parallel to the plane of said floor and a connecting plate at a center of said lower bar rotatably engaged to said shaft;

a first end of each of two v-shaped arms integrally engaged to each end of said lower bar;

said v-shaped arms rising above said lower bar at an acute angle to said plane of said floor;

a first reinforcing bar parallel to said lower bar fixedly engaged at its ends respectively to each of said two v-shaped arms;

a first tubular member fixedly engaged to said connecting plate and a center of said first reinforcing bar; and a second tubular member, disposed in said first tubular member having a pair of bearings disposed therein at both ends;

a first end of a slidable bar slidably engaged within said pair of bearings;

said slidable bar having a pair of transverse pins limiting slidable movement of said first end of said slidable bar within said second tubular member;

control means threadingly engaged through said first tubular member and said second tubular member for fixing said slidable bar relative to said second tubular member;

a first edge of each of a back and a seat of said chair being rotatably engaged to each other;

a second end of said slidable bar being rotatably engaged to a bottom of said seat;

a second end of each of said two v-shaped arms rotatably engaged to side edges of said back;

wherein, when said control means is disengaged from said slidable bar, a user can adjust the inclination of said back and said seat to a desirable angle and then fix said back and said seat at said angle by fixing said control means to said slidable bar.

* * * * *